United States Patent [19]

Wardell, Jr.

[11] 4,245,205

[45] Jan. 13, 1981

[54] CONVERGENCE ADJUSTMENT ARRANGEMENT USING MAGNETIC TABS WITH DIFFERENTIAL MOTION AND ROTARY DRIVE

[75] Inventor: Myron H. Wardell, Jr., Lititz, Pa.

[73] Assignee: RCA Corporation, New York, N.Y.

[21] Appl. No.: 12,074

[22] Filed: Feb. 14, 1979

[51] Int. Cl.[3] ..... H01F 1/00

[52] U.S. Cl. ..... 335/212; 335/210

[58] Field of Search ..... 335/210, 212

[56] References Cited

U.S. PATENT DOCUMENTS

| | | | |
|---|---|---|---|
| 3,290,532 | 12/1966 | Lemke et al. | 335/212 X |
| 3,290,533 | 12/1966 | Ammerman | 313/77 |
| 3,305,744 | 2/1967 | Werst | 313/77 |
| 3,332,046 | 7/1967 | Melone | 335/212 |
| 3,605,053 | 9/1971 | Anthony | 335/212 |
| 3,743,985 | 7/1973 | Nishimura et al. | 335/212 |
| 3,942,146 | 3/1976 | LaBelle | 335/212 |

FOREIGN PATENT DOCUMENTS 1535192 12/1978 United Kingdom .

*Primary Examiner*—Fred L. Braun

*Attorney, Agent, or Firm*—Eugene M. Whitacre; Paul J. Rasmussen; Scott J. Stevens

[57] ABSTRACT

A convergence correction arrangement for a television display system using a deflection yoke mounted coaxially upon the neck of a kinescope includes first and second magnetically permeable tabs contiguous with the beam entrance end of the yoke. The tabs are located on opposite sides of the axis and a fixed separation is maintained between them. A first track constrains the tabs against tangential motion relative to the axis while permitting radial motion. A rotary drive arrangement suited to being engaged by a yoke adjustment machine includes a second track having radial and tangentially-directed components. The second track engages the tabs whereby roatary motion of the rotary drive arrangement drives the convergence-adjusting tabs radially and provides differential motion of the tabs relative to the axis for convergence control.

7 Claims, 5 Drawing Figures

CONVERGENCE ADJUSTMENT ARRANGEMENT USING MAGNETIC TABS WITH DIFFERENTIAL MOTION AND ROTARY DRIVE

BACKGROUND OF THE INVENTION

This invention relates to a convergence adjustment for a color TV kinescope display arrangement suited for adjustment on a multipurpose yoke adjustment machine.

Color television kinescopes or picture tubes create images having portions of different colors by causing electrons to impinge upon or illuminate phosphors having different emissions. Normally, phosphors having red, green and blue light emission are used, grouped into myraid trios or triads of phosphor areas, with each triad containing one phosphor area of each of the three colors.

In the kinescope, the phosphors of each of the three colors are illuminated by an electron beam which is intended to impinge upon phosphors of only one color. Each electron beam has a relatively large cross-section compared with a phosphor triad, and each beam illuminates several triads. The three electron beams are generated by three electron guns located in a neck portion of the kinescope opposite the viewing screen formed by the phosphors. The electron guns are oriented so that the beams as generated leave the guns in parallel or somewhat converging paths directed towards the viewing screen. In order to allow the display of a gamut of colors, the phosphor array in a given area must be illuminated by the three electron beams with an intensity dependent upon the color to be displayed. The three electron beams leaving the electron guns in separate parallel paths will if uncorrected illuminate the viewing screen in three different locations, forming separated dots of different colors. In order to enable a single illuminated area to display a color gamut, the electron beams are caused to converge at or near the viewing screen. At the center of the screen, this may be accomplished by the use of a permanent magnet assembly mounted in the neck region of the kinescope for producing a static magnetic field which causes the three beams to converge or register at the center of the viewing screen. This adjustment is known as "static convergence."

With the three electron beams illuminating the same area of the viewing screen, some means must be provided for color separation. This is accomplished by the shadow mask. The shadow mask is a conductive screen or grill having large numbers of perforations through which portions of the electron beams may pass. Each perforation is in a fixed position relative to each triad of color phosphor areas. Portions of the electron beams pass through one or more of the perforations and the portions of each beam begin to diverge and separate from the portions of the other beams as they approach the viewing screen. At the viewing screen the portions are separated and fall upon the appropriate phosphor color based upon the direction of electron beam incidence. That is, each electron beam approaches a given group of perforations from a slightly different direction and the beams are split into a number of smaller beam portions before falling upon the appropriate individual color phosphor areas. The method depends upon a high order of accuracy in the placement of the phosphor triads relative to the perforations and the apparent source of the electron beams. In order to insure that the apparent source of the electron beam is correct, a "purity" adjustment is made by which each beam is caused to illuminate only a particular one of the phosphor areas of each triad.

In order to form a two-dimensional image, the lighted dot on the viewing screen caused by the three statically converged electron beams must be moved both horizontally and vertically over the viewing screen to form a lighted raster area. This is accomplished by means of magnetic fields produced by a deflection yoke mounted upon the neck of the kinescope. The deflection yoke commonly deflects the electron beam with substantially independent horizontal and vertical deflection systems. Horizontal deflection of the electron beam is provided by pairs of conductor arrays of the yoke which produce a magnetic field having vertically extending field lines. The amplitude of the magnetic field is varied with time at a relatively high rate. Vertical deflection of the electron beams is accomplished by pairs of conductor arrays producing a horizontally extending magnetic field which varies with time at a relatively low rate.

A permeable magnetic core is associated with the yoke conductors. The conductors are formed into continuous windings or coils by return conductors which may enclose the core within the coil to form a toroidal deflection winding, or which form a saddle coil winding if the coil does not enclose the core.

The viewing screen is relatively flat. The electron beam, which traverses a given distance from the point or center of deflection to the center of the viewing screen, will traverse a greater distance when deflected towards the edge of the viewing screen. From geometrical considerations, it may be expected that the electron beams will converge at a point on the surface of a sphere centered at the point of deflection. This alone would result in a separation of the landing points of the three electron beams away from the center of the screen. In addition, unavoidable longitudinal components of the deflecting magnetic field cause the electron beams to be more strongly converged whereby the surface at which the beams converge is further distorted. These effects combine to cause the light spots generated by the three beams at points away from the center of the viewing screen to be separated, even though each of the beam illuminates only its appropriate color phosphor. This is known as misconvergence, and results in color fringes about the displayed images. A certain amount of misconvergence is tolerable, but complete separation of the three illuminated spots is generally not. Misconvergence may be measured as a separation of the ideally superimposed red, green and blue lines of a crosshatch pattern of lines appearing on the raster as an appropriate test signal is applied to the receiver.

Formerly, kinescopes had the electron guns in a triangular or delta configuration. Convergence of the electron beams to form a coalesced light spot at points away from the center of the viewing screen was accomplished in delta-gun systems by dynamic convergence arrangements including additional convergence coils mounted about the neck of the kinescope and driven at the deflection rates by dynamic convergence circuits, as described in U.S. Pat. No. 3,942,067 issued Mar. 2, 1976 to Cawood.

As described in U.S. Pat. No. 3,789,258 issued Jan. 29, 1974 to Barbin, and in U.S. Pat. No. 3,800,176 issued Mar. 26, 1974 to Gross and Barkow, current television display arrangements utilize an in-line electron gun assembly together with a self-converging deflection yoke arrangement including deflection windings for producing negative horizontal isotropic astigmatism and positive vertical isotropic astigmatism for balancing the convergence conditions of the beams on the deflection axes and in the corners such that the beams are substantially converged at all points on the raster. This eliminates the need for dynamic convergence coils and circuits. With the increased deflection angles necessitated by commercially desirable short kinescopes, the deflection yoke is required to correct for pincushion and other raster distortions as well as provide satisfactory self-convergence. The magnetic field nonuniformity providing the isotropic astigmatism necessary for self-convergence makes the convergence dependent upon the position of the longitudinal axis of the yoke relative to the longitudinal axis of the kinescope. This sensitivity together with normal manufacturing tolerances makes it necessary to adjust the yoke transversely relative to the kinescope to achieve the best compromise convergence, but may affect the raster distortion. If a position is selected for the yoke in which the raster distortion is satisfactory, there may be a residual convergence error. It is known that placing a permeable tab adjacent the yoke can correct the residual convergence error, but finding the correct side of the kinescope on which to apply the tab, locating the proper position and affixing the tab to the yoke with glue is time-consuming, because the alignment operator is normally in front of the kinescope while performing other alignments, and must be behind the kinescope to add the tabs. It is desirable to have an arrangement by which an alignment operator may conveniently correct residual convergence error.

A convergence correction arrangement for deflection yoke adapted to be disposed about and coaxial with an in-line beam kinescope is described in United States Patent Application Ser. No. 951,001, filed Oct. 13, 1978 now abandoned, in the name of Barkow, et al. This convergence correction arrangement includes first and second magnetic field influencers located on opposite sides of the axis of the kinescope-deflection yoke system. These influencers or tabs are mounted on a plastic slider adapted for vertical movement, thereby providing differential adjustment of the tabs relative to the kinescope.

Kinescope-deflection yoke arrangements are currently aligned with the aid of a yoke adjustment machine (YAM). The yoke adjustment machine is arranged so that the operator can mount a kinescope and yoke from the front of the machine, and remotely control the engagement of the tube socket, the rotational position of each of three sets of magnets associated with the static convergence apparatus, the position of each of four convergence magnets and the x,y,z and rotational position of the yoke relative to the tube. The mechanisms by which these remote connections and adjustments are performed must be nonmagnetic in order to avoid perturbing the adjustment procedure. Consequently, the mechanism is an intricate arrangement of remote-control drive chains, gears and rods actuated by remote motors. The aforementioned convergence correction arrangement as described by Barkow, et al., while satisfactory for a less intricate YAM, has the disadvantage that at the extremes of the positioning of the magnetic tabs the sliding support upon which the tabs are mounted projects beyond the edge of the main portion of the yoke body. Thus, the slider of the Barkow, et al., arrangement may interfere with a YAM mechanism in any but its center position. It is desirable to have a convergence correction arrangement by which magnetic tabs at the rear of the yoke may be moved vertically with a differential motion by a mechanism which does not project beyond the rear of the yoke or farther than the extreme position taken by the tab.

SUMMARY OF THE INVENTION

A convergence correction arrangement for a deflection yoke adapted to be disposed about and substantially coaxial with an in-line kinescope includes first and second magnetic field influencing tabs disposed at the rear of the yoke on opposite sides of the axis. A fixed separation is maintained between the tabs, and differential movement of the first and second tabs relative to the axis is provided for convergence correction adjustment. An improved arrangement for driving the tabs includes a first track coupled to the body of the yoke and to the tabs for restraining the tabs against tangential components of motion about the axis while permitting radial motion. A rotational drive arrangement is rotatably coupled to the body of the yoke and includes a second track coupled to the tabs. The second track has a direction including radial and tangentially-extending components. The second track is coupled to the tabs for converting a rotational force on the rotational drive arrangement to a radial force on the tabs.

DESCRIPTION OF THE INVENTION

Figure 1:
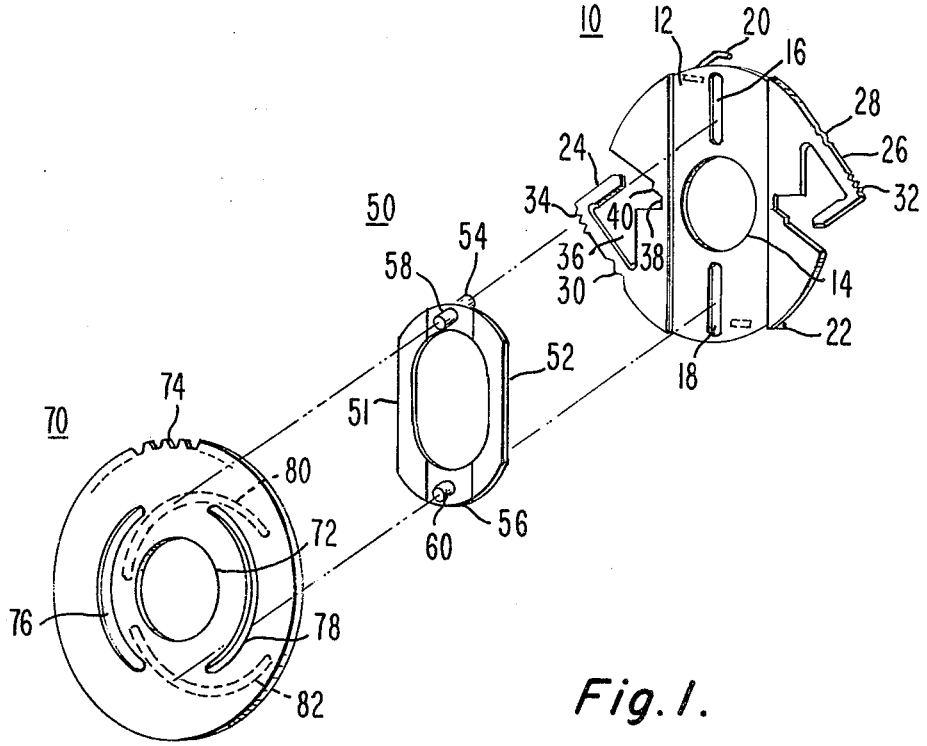
FIG. 1 is a perspective view of a convergence adjustment arrangement embodying the invention, which may be mounted upon a kinescope and deflection yoke assembly.
Figure 2:
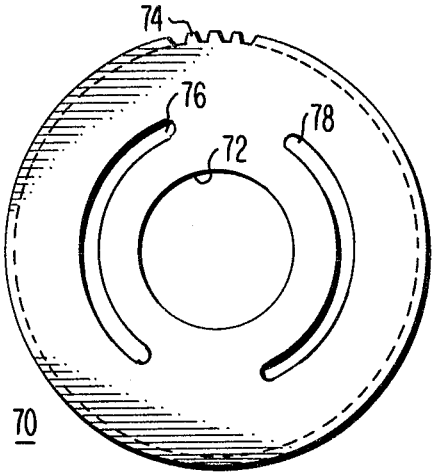
FIGS. 2 to 5 represent individual portions or components of the arrangement of FIG. 1.
Figure 3:
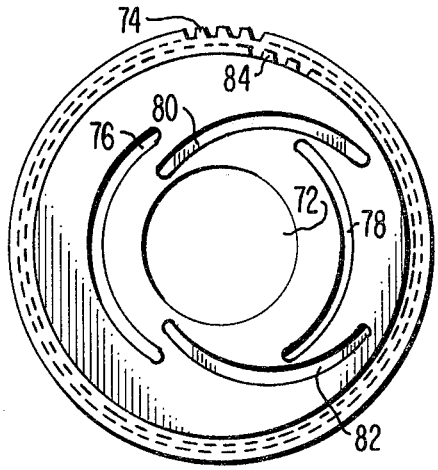
Figure 4:
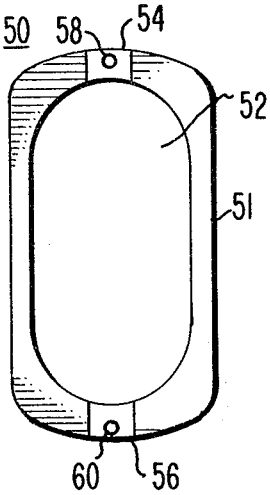
Figure 5:
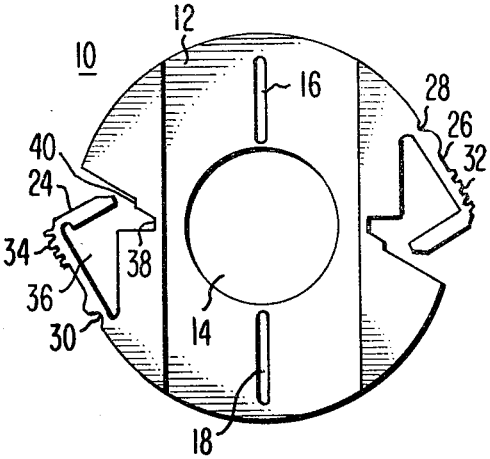

In FIG. 1, a circular baseplate designated generally as 10 includes a central aperture 14 dimensioned to clear the neck of a deflection yoke, not shown. Baseplate 10 also includes locking arms or tabs 20 and 22 by which the baseplate can be affixed to the rear or beam entrance end of a deflection yoke, not shown. Baseplate 10 includes a vertically-extending channel 12 and vertically extending slots 16 and 18 centered in channel 12.

Baseplate 10 is molded from a relatively flexible plastic material. Locking arms 24 and 26 are molded integrally with the other portions of baseplate 10. Arm 24 includes a flexure point or hinge 30 which allows arm 24 to be moved relative to baseplate 10. In one extreme of its position, the major portion of arm 24 is within a cutout 36, the outermost portions of arm 24 then lie within the radius of the principal portion of baseplate 10. Locking arm 26 includes a flexure point 28 for a similar purpose. Locking arms 24 and 26 include locking teeth 32 and 34, respectively.

The convergence adjustment arrangement also includes a tab carrier designated generally as 50. Tab carrier 50 has a flat body 51 defining a central aperture 52. Body portion 51 of carrier 50 is dimensioned to fit within and slide along channel 12. The smaller dimension of central aperture 52 clears the neck of the kinescope. Tabs 54 and 56 of magnetically permeable material are implanted at the top and bottom of body 51. These tabs are intended to influence the magnetic field extending to the rear of the yoke and provide convergence adjustment. A set of pins 58 and 60 projects from the top and bottom of body 51. That portion of pin 58 extending towards baseplate 10 is intended to index with slot 16. Similarly, that portion of pin 60 projecting towards baseplate 10 is intended to index with slot 18. The indexing of pins 58 and 60 with slots 16 and 18, together with the mating of the sides of body 51 with the sides of channel 12 constrain body 50 from any rotational motion relative to baseplate 10 and together act as a track allowing only vertical motion of carrier 50.

The convergence adjustment arrangement further includes a rotary drive plate designated generally as 70. As illustrated, drive plate 70 includes a central aperture 72 through which the neck of the kinescope can project. The outer diameter of drive plate 70 is somewhat larger than the outer diameter of baseplate 10 and is approximately equal to the diameter of the rear of the yoke to which it is affixed. A drive gear illustrated as 74 forms the outer periphery of drive plate 70. Gear 74 is adapted to be engaged by a drive gear of the YAM.

A second track formed by a pair of channels 80 and 82 is formed in the side of drive plate 70 facing tab carrier 50. Channels 80 and 82 are intended to index with pins 58 and 60, respectively. The distance between tracks 80 and 82 along any diameter of drive plate 70 equals the distance between pins 58 and 60. Channels 80 and 82 extend in directions including both radial and tangential components relative to the central axis of the baseplate. When assembled, tab carrier 50 fits within channel 12 to form a substantially flush surface against which the principal portion of drive plate 70 can bear. The outer periphery of drive plate 70, however, overlaps the outer diameter of baseplate 10. An internal tooth structure 84 is formed in the periphery of drive plate 70 in this overlap region to allow the plates to be locked together after adjustment. A pair of through slots 76, 78 are formed at a fixed radius from the center of drive plate 70. Slots 76 and 78 overlap a portion of locking arms 24 and 26 to provide access for forcing locking arms 24 and 26 outward and thereby engage toothed portions 32 and 34 against the internal toothed portion of drive plate 70 in order to lock the entire assembly together after adjustment.

In operation, faceplate 10 is affixed to the rear of the deflection yoke and kinescope assembly by slipping central aperture 14 of baseplate 10 over the neck of the kinescope and engaging the yoke with locking tabs 20 and 22. Baseplate 10 is thereby oriented in a position in which channel 12 and slots 16, 18 extend vertically. Central aperture 52 of tab carrier 50 is slipped over the neck, and body 51 is pushed into channel 12. Central aperture 72 of drive plate 70 is then placed over the neck of the kinescope, and rotated so as to index pins 58 and 60 with tracks 80 and 82. Locking arms 24 and 26 are then depressed so as to pivot them at hinge points 28 and 30 and thereby depress toothed portions 32, 34 below the radius of the principal portion of baseplate 10. Drive plate 70 is then pushed into engagement with pins 58, 60 and locking arms 24, 26.

The complete assemblage of kinescope, yoke and convergence adjustment arrangement can then be mounted into a YAM for adjustment. During the adjustment, a drive gear of the YAM engages drive gear 74 of drive plate 70 and turns it relative to baseplate 10. This causes index pins 58 and 60 to ride to a different position along tracks 80 and 82. However, the rotational motion imparted to drive plate 70 cannot cause a rotational motion of carrier 50 because of the indexing of pins 58 and 60 with slots 16 and 18 of baseplate 10, and also because the sides of channel 12 bear upon the sides of body 51.

After completion of the convergence adjustment by rotation of drive plate 70, the alignment operator inserts a screwdriver through slot 76 and engages it between the end of locking arm 24 and cutoff 36 to force the end of the locking arm out of bottom portion 38 of cutout 36, whereby the end of arm 24 will snap into engagement with portion 40 of cutout 36. This forces tooth portion 34 of locking arm 24 against the internal tooth portion of drive plate 70. Similarly, a screwdriver inserted through slot 78 is used to force tooth portion 32 of locking arm 26 against the internal toothed portion of the drive plate. Thus, drive plate 70 is fixed in position with respect to baseplate 10, and the tabs on carrier 50 are also held in a fixed position relative to baseplate 10 and the rear of the yoke.

It will be apparent to those skilled in the art that either slots 16, 18 or channel 12, alone, would be sufficient to restrain tab carrier 50 against rotary motion and thus either alone may serve as the first track. Thus, slots 16, 18 when used in conjunction with channel 12 may be a loose fit so as to merely provide stop limits to the vertical motion of carrier 50 in channel 12. Other arrangements may be used for locking drive plate 70 to baseplate 10 upon the completion of adjustment, as for example by the use of screws or adhesive rather than by the use of locking arms.

It is also apparent that body 51 of tab carrier 50 establishes a fixed separation between tabs 54 and 56, and thus motion of either tab will cause the other to move in a tracking relation. Consequently, only one of channels 80 or 82 and the pins with which they index is necessary.

It is also possible to eliminate body 51 of carrier 50 altogether, so long as the tabs are fitted with suitable projecting pins. With this arrangement, the fixed separation between the tabs is determined by the radial separation of tracks 80 and 82. Such a configuration if used without a channel might allow the tabs to rotate about the pins if single pins were to be used as illustrated. Such a rotation could be prevented by the use of multiple pins engaging the track.

It is also possible to make the tracks from ridges projecting from the surface of the drive plate and/or baseplate. With such an arrangement, the ridges would engage matching slots or depressions in the tabs or in the tab carrier.

Finally, it will be apparent that baseplate 10 can be formed as an integral portion of the rear of the deflection yoke itself for savings in both material and in assembly labor.

What is claimed is:

1. A convergence correction arrangement for a deflection yoke adapted to be disposed about and substantially coaxial with an in-line kinescope, comprising:

first and second magnetic field influencing tabs disposed at the rear of the yoke, said first and second tabs being located on opposite sides of the axis of the kinescope; and mounting and drive means for maintaining a substantially fixed separation between said first and second tabs and for providing for differential movement of said first and second tabs relative to said axis for adjustment, wherein the improvement in said mounting and drive means comprises:

mounting means incorporating first track means coupled to the body of said yoke and to said tabs for restraining said tabs against tangential motion about said axis while allowing radial motion;

rotational drive means rotatably coupled to said mounting means and including second track means coupled to said tabs, said second track means having radially and tangentially-extending components, said second track means being coupled to said tabs for converting a rotational force on said rotational drive means to a radial force on said tabs; and locking means comprising:

a flexible arm secured to one of said mounting means and drive means and selectively positionable between a first captive position and a second released position, said arm incorporating first coupling means; and second coupling means secured to the other of said mounting means and drive means and subject to engagement with said first coupling means to prevent rotation of said drive means with respect to said mounting means only when said arm is in its second position.

2. An arrangement according to claim 1 wherein said first track means comprises first and second radially-extending slots formed in said mounting means.

3. An arrangement according to claim 2 wherein said first and second tabs include projections for engaging said first and second slots.

4. An arrangement according to claim 3 wherein said second track means comprises at least a third and fourth slots formed in said drive means, and wherein said tabs further comprise projections coupled to said third and fourth slots.

5. An arrangement according to claim 1 wherein said drive means comprises engagement means adapted for coupling to a YAM.

6. An arrangement for providing radial motion to magnetic field influencers for a deflection yoke adapted to be disposed about and substantially coaxial with a kinescope, comprising:

a base plate incorporating a first radial track contiguous with said yoke;

drive means coaxial with said yoke and mounted for rotation relative thereto, said drive means comprising a second track including radial and tangential components;

first and second track coupling means coupled to said influencers, said first track coupling means being coupled to said first track and said second track coupling means being coupled to said second track for promoting radial motion of said influencer in response to rotational motion of said drive means;

a flexible arm secured to said base plate and selectively positionable between a first captive position and a second released position, said arm incorporating first locking means; and second locking means secured to said drive means and subject to engagement with said first locking means to prevent rotational movement of said drive means only when said arm is in its second position.

7. A convergence adjustment arrangement for a color display system including a deflection yoke mounted coaxially with a kinescope, comprising:

first and second permeable tabs;

first track means affixed to the rear portion of the yoke and coupled to said first and second tabs for constraining said tabs to vertical motion;

a tab carrier interconnecting said first and second tabs for maintaining a fixed distance therebetween;

rotary drive means rotatably coupled to said yoke and including second track means coupled to said tab carrier for imparting radial motion to said tab carrier for driving said tabs in tandem in a vertical direction for imparting a differential motion thereto relative to the axis;

a flexible arm secured to said first track means and selectively positionable between a first captive position and a second released position, said arm incorporating first engagement means; and second engagement means secured to said rotary drive means and subject to engagement with said first engagement means to prevent rotation of said drive means with respect to said first track means only when said arm is in its second position.

* * * * *